US009758745B2

(12) United States Patent
Gu et al.

(10) Patent No.: US 9,758,745 B2
(45) Date of Patent: Sep. 12, 2017

(54) PROCESS OF MAKING A LIQUID CLEANING COMPOSITION

(71) Applicant: The Procter & Gamble Company, Cincinnati, OH (US)

(72) Inventors: Chong Gu, Beijing (CN); Vincenzo Guida, Rome (IT); Geoffrey Marc Wise, Cincinnati, OH (US); Wei Dai, Beijing (CN); Bernie George Durham, Mason, OH (US); Boon Ho Ng, Beijing (CN); Fang Hu, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 127 days.

(21) Appl. No.: 14/461,648

(22) Filed: Aug. 18, 2014

(65) Prior Publication Data

US 2015/0072914 A1 Mar. 12, 2015

(30) Foreign Application Priority Data

Sep. 9, 2013 (WO) ..... PCT/CN2013/083117

(51) Int. Cl.

| | |
|---|---|
| ***C11D 1/12*** | (2006.01) |
| ***C11D 3/34*** | (2006.01) |
| ***C11D 1/14*** | (2006.01) |
| ***C11D 1/29*** | (2006.01) |
| ***C11D 1/37*** | (2006.01) |
| ***C11D 11/00*** | (2006.01) |
| *C11D 1/22* | (2006.01) |

(52) U.S. Cl.

CPC ..... *C11D 1/12* (2013.01); *C11D 1/146* (2013.01); *C11D 1/29* (2013.01); *C11D 1/37* (2013.01); *C11D 3/3463* (2013.01); *C11D 11/0094* (2013.01); *C11D 1/22* (2013.01)

(58) Field of Classification Search

None

See application file for complete search history.

(56) References Cited

U.S. PATENT DOCUMENTS

| | | | | |
|---|---|---|---|---|
| 4,191,704 | A | 3/1980 | Mather | |
| 5,489,392 | A | 2/1996 | Capeci et al. | |
| 5,516,448 | A | 5/1996 | Capeci et al. | |
| 6,200,937 | B1 * | 3/2001 | Brennan ..... | A61K 8/416 510/119 |
| 6,479,442 | B1 | 11/2002 | Berube et al. | |
| 6,589,927 | B1 | 7/2003 | Kott et al. | |
| 6,730,650 | B1 | 5/2004 | Wood | |
| 6,779,539 | B1 | 8/2004 | Schwamberger et al. | |
| 6,815,525 | B2 | 11/2004 | DeBruin | |
| 7,008,646 | B2 | 3/2006 | Spicer et al. | |
| 8,440,605 | B2 | 5/2013 | Wise | |
| 9,109,189 | B2 | 8/2015 | Perez-Prat Vinuesa et al. | |
| 2004/0023822 | A1 | 2/2004 | Ochs et al. | |
| 2007/0044824 | A1 | 3/2007 | Capeci et al. | |
| 2008/0139434 | A1 | 6/2008 | Basappa et al. | |
| 2011/0065626 | A1 | 3/2011 | Courchay | |

FOREIGN PATENT DOCUMENTS

| | | | |
|---|---|---|---|
| EP | 0 507 402 | A1 | 7/1992 |
| WO | WO 2011/114876 | A1 | 9/2011 |

OTHER PUBLICATIONS

International Search Report for application No. PCT/CN2013/083117, dated Nov. 20, 2015, 12 pages.

* cited by examiner

*Primary Examiner* — Necholus Ogden, Jr.
(74) *Attorney, Agent, or Firm* — Gregory S. Darley-Emerson; Leonard W. Lewis; Steven W. Miller

(57) ABSTRACT

In a process of making a liquid cleaning composition, adding a gel breaker upstream of an anionic surfactant addition in the recirculatory loop of a recirculatory batch processor mitigates the viscous hexagonal phase whilst providing maximum flexibility in formulating various ingredients in the composition.

10 Claims, No Drawings

PROCESS OF MAKING A LIQUID CLEANING COMPOSITION

FIELD OF THE INVENTION

The present invention relates to a process of making a liquid cleaning composition and a recirculatory batch processor.

BACKGROUND OF THE INVENTION

Many common surfactants used in cleaning compositions are difficult to handle in a concentrated form. In particular, it is known that some anionic surfactants such as alkyl sulfates (AS) and alkyl ethoxy sulfates (AES) exhibit a prohibitively viscous hexagonal phase for concentrations in the range of roughly 30% to 60% by weight active surfactant, while exhibiting a thick but flowable lamellar phase at somewhat higher concentrations.

To save on transportation and storage costs, it is desired to handle these anionic surfactants in a concentrated form. However, in order to dilute the lamellar phase into an isotropic phase as typically in the final liquid cleaning composition, care must be taken to mitigate the hexagonal phase or at least shorten the time of transitioning through the hexagonal phase. Otherwise, it can take hours to days to dilute this highly viscous hexagonal phase further due to the slow mixing dynamics, rendering dilution of the lamellar phase via simple mixing as impractical on an industrial scale.

To mitigate the hexagonal phase, one approach in the prior art is to add a second material, usually a hydrotrope, to the lamellar surfactant. Where the addition of another material to mitigate the hexagonal phase is not desirable, the common solution is to dilute the lamellar phase very carefully into water. However, both of the approaches require separation of the dilution operation and may even face a subsequent issue of removing the undesired material or excessive amount of water from the final composition.

Moreover, some ingredients in the liquid cleaning composition are known to act as a gel breaker (in addition to their principal role in the cleaning composition), and the prior art discloses utilizing these ingredients to dilute the concentrated lamellar surfactants. This approach indeed eliminates the need for a separate dilution operation as well as the need for a subsequent step of removing undesired material or excessive amount of water. However, this approach is typically conducted in an in-line process and the gel breaker is diluted by other ingredients in the cleaning composition, thereby diminishing an ingredient's impact as a gel breaker. Also, this approach requires a deep understanding of the impact of formulation ingredients on the phase behavior and a precise control of ratios of the ingredients in the formulation, both of which are difficult to achieve, particularly on an industrial scale. Furthermore, this approach is not flexible for a range of formulations given the complexity posed by varying ingredients and concentrations.

Therefore, there is a need for a process of making a liquid cleaning composition that mitigates the hexagonal phase whilst allowing for maximum flexibility in formulating various ingredients in the composition.

It is an advantage of the present invention to provide a process of making a liquid cleaning composition that allows for expanding production capacity.

It is another advantage of the present invention to provide an efficient process of making a liquid cleaning composition without requiring a precise control of ratios of ingredients or relatively high energy input.

It is yet another advantage of the present invention to provide a process of making a liquid cleaning composition, which increases the processible surfactant concentration range and which eliminates the need for a separate dilution operation as to concentrated surfactants as well as the need for a subsequent step of removing undesired material or excessive amount of water.

SUMMARY OF THE INVENTION

In one aspect, the present invention is directed to a process of making a liquid cleaning composition, comprising the steps of:

a) providing a recirculatory batch processor, wherein the recirculatory batch processor comprises: i) a batch container containing a liquid composition precursor; and ii) a recirculatory loop in fluid communication with the batch container, recirculating at least a portion of the liquid composition precursor;

b) dispensing a first anionic surfactant into the loop at a first loop location while at least a portion of the liquid composition precursor is recirculating, wherein the first anionic surfactant is selected from the group consisting of alkyl sulfate (AS), alkyl ethoxy sulfate (AES), and a combination thereof; and c) dispensing a gel breaker into the loop at a second loop location while at least a portion of the liquid composition precursor is recirculating, wherein the second loop location is upstream of the first loop location, thereby making the liquid cleaning composition.

In another aspect, the present invention is directed to a liquid cleaning composition obtained by the process.

In yet another aspect, the present invention is directed to a recirculatory batch processor comprising: a batch container; a recirculatory loop in fluid communication with the batch container; a first dispenser in fluid communication with the loop for dispensing a first anionic surfactant at a first loop location into the loop; and a second dispenser in fluid communication with the loop for dispensing a gel breaker at a second loop location into the loop, wherein the second loop location is upstream of the first loop location, and wherein the first anionic surfactant is selected from the group consisting of alkyl sulfate (AS), alkyl ethoxy sulfate (AES), and a combination thereof.

DETAILED DESCRIPTION OF THE INVENTION

According to the process of the present invention, the first anionic surfactant is diluted while mitigating the highly viscous hexagonal phase. Specifically, the upstream gel breaker meets with the first anionic surfactant in the recirculatory loop and helps dilute the first anionic surfactant. Without wishing to be bound by theory, it is believed that the gel breaker alters the phase chemistry and mixing dynamics of the first anionic surfactant, thereby narrowing the range of the hexagonal phase of the first anionic surfactant. Thus, the hexagonal phase of the first anionic surfactant is mitigated, or at least the time of the first anionic surfactant transitioning through the hexagonal phase is shortened upon dilution.

Moreover, due to the specific structure of the recirculatory batch processor of the present invention, ingredients other than those functioning as a gel breaker in the liquid cleaning composition do not impact the phase chemistry and mixing dynamics of the first anionic surfactant significantly. As will be illustrated hereinafter, these ingredients are added either to the loop (loop components) or to the batch container (batch components). When these ingredients flow to the first loop location, the concentrations thereof are too limited to materially impact the phase behavior of the first anionic surfactant. Rather, the gel breaker dominates the fluid passing through the first loop location given the relative position of the gel breaker and the first anionic surfactant in the loop. Thus, the present invention does not require either much effort to fully understand the complex influence of the various ingredients in the composition on the phase behavior or a precise control of ratios of the ingredients. In contrast, by simply dispensing the gel breaker upstream of the first anionic surfactant into the loop, the process of the present invention allows for maximum flexibility in formulating various ingredients in the composition.

Definitions

As used herein, the term "liquid cleaning composition" means a liquid composition relating to cleaning or treating: fabrics, hard or soft surfaces, skin, hair, or any other surfaces in the area of fabric care, home care, skin care, and hair care. The cleaning compositions include, but are not limited to: laundry detergent, laundry detergent additive, fabric softener, carpet cleaner, floor cleaner, bathroom cleaner, toilet cleaner, sink cleaner, dishwashing detergent, air care, car care, skin moisturizer, skin cleanser, skin treatment emulsion, shaving cream, hair shampoo, hair conditioner, and the like. Preferably, the liquid cleaning composition is a liquid laundry detergent composition, a liquid fabric softener composition, a liquid dishwashing detergent composition, or a hair shampoo, more preferably is a liquid laundry detergent composition or a hair shampoo, most preferably is a liquid laundry detergent composition. The liquid cleaning composition may be either aqueous or non-aqueous, and may be anisotropic, isotropic, or combinations thereof.

As used herein, the term "liquid composition precursor" refers to a composition that forms in the batch container and that precedes the liquid cleaning composition during the process of the present invention. At least a portion of the liquid composition precursor recirculates in the recirculatory loop. The liquid composition precursor includes the composition as it is modified by batch components and loop components that are added during the present process. For example, a first anionic surfactant may be added into the loop in a first recirculatory pass of the liquid composition precursor, and after each pass more of the first anionic surfactant may be added into the liquid composition precursor thereby increasing the concentration of the first anionic surfactant in the liquid composition precursor, yet this changing formulation is still referred to as the "liquid composition precursor".

As used herein, the term "gel breaker" refers to one or more chemical compounds that function to efficiently modify the viscous hexagonal phase of anionic surfactants to a less viscous isotropic phase.

As used herein, the term "batch component" refers to an ingredient added to the batch container, and the term "loop component" refers to an ingredient added to the recirculatory loop. The two terms are distinguished by the location where the ingredient is added, i.e., an ingredient can be both a batch component and a loop component if it is added both to the batch container and to the loop. The first anionic surfactant and the gel breaker, both added into the loop, are loop components. In addition to the first anionic surfactant and the gel breaker, a third ingredient that is added into the loop is referred to as "third loop component".

As used herein, the terms "lamellar phase" and "hexagonal phase" refer to two major types of liquid-crystalline phases. In the lamellar phase (known as $L_\alpha$ phase), the surfactants form sheets of bi-layers with the polar headgroups oriented outwards and the fatty acid moieties oriented into the hydrophobic core between the two bi-layers. In the hexagonal phase, the surfactants form a spherical aggregate with the polar headgroups oriented either into the centre of the sphere (known as $H_2$ phase) or towards the surface of the sphere (known as $H_1$ phase). Active concentrations of surfactant in the lamellar phase are typically above 60% by weight, higher than those in the hexagonal phase which are roughly 30% to 60%. Both of the lamellar phase and hexagonal phase can be observed via polarizing microscope.

As used herein, the term "upstream" refers to a point in the recirculatory loop positioned closer to the loop inlet (i.e., farther from the loop outlet) relative to another point in the loop. The term "downstream" is the antonym of "upstream". The term "loop inlet" herein refers to the point where the liquid composition precursor flows into the loop (from the batch container), and the term "loop outlet" herein refers to the point where the liquid composition precursor in the loop exits the loop and flows back into the batch container. It is clearly understood that the loop inlet is upstream of the loop outlet relative to the flow of the liquid composition precursor flowing in the loop.

As used herein, the term "recirculate" means the liquid composition precursor flowing in the recirculatory loop of the present invention. The liquid composition precursor recirculating in the loop could flow either for a single pass or for several or even numerous passes.

As used herein, the term "dispenser" refers to a device that dispenses an ingredient. The dispenser can be in fluid communication with a storage container that contains the ingredient. Alternatively, the dispenser per se can function as a storage container as well, i.e., for containing and dispensing the ingredient. Non-limiting examples of the dispensers include "T-injection" and "concentric injection". The term "T-injection" herein refers to an injector shaped like the letter "T", in which one loop component is fed to the liquid composition precursor and meets with the liquid composition precursor at the intersection point of "T". The term "concentric injection" herein refers to an open-ended concentric feed tube positioned in the loop and extending longitudinally along at least a portion of the loop. In the concentric injection, typically one loop component is fed through the concentric feed tube and the liquid composition precursor flows in the hollow tube, and the loop component and the liquid composition precursor meet at the point where the open-ended concentric feed tube ends (i.e., the first loop location).

As used herein, the term "mix" refers to adding ingredients together and achieving homogeneity, and the term "mixture" refers to a homogenous mixture of ingredients.

As used herein, the term "combination" refers to ingredients added together with or without substantial mixing towards achieving homogeneity.

As used herein, the term "residence time" means the length of the time that a fluid stays or flows in a defined location of a device, e.g., the residence time of the liquid composition precursor passing through a mixer, or the residence time of the liquid composition precursor contained in a batch container.

As used herein, the term "alkyl" means a hydrocarbyl moiety which is branched or unbranched, saturated or unsaturated. Included in the term "alkyl" is the alkyl portion of acyl groups.

As used herein, when a composition is "substantially free" of a specific ingredient, it is meant that the composition comprises less than a trace amount, alternatively less than 0.1%, alternatively less than 0.01%, alternatively less than 0.001%, by weight of the composition, of the specific ingredient.

As used herein, the terms "a)", "b)", and "c)" directed to the steps in the process of the present invention do not mean a sequential order. For example, step a) could occur before step b) or after step b), or steps b) and c) occur simultaneously, or step b) occurs after step c).

As used herein, the articles including "a" and "an" when used in a claim, are understood to mean one or more of what is claimed or described.

As used herein, the terms "comprise", "comprises", "comprising", "include", "includes", "including", "contain", "contains", and "containing" are meant to be non-limiting, i.e., other steps and other ingredients which do not affect the end of result can be added. The above terms encompass the terms "consisting of" and "consisting essentially of".

Liquid Cleaning Composition

The liquid cleaning composition obtained according to the process of the present invention comprises a first anionic surfactant, an ingredient that is capable of functioning as a gel breaker, and preferably one or more adjunct ingredients.

Because of the gel breaker, the hexagonal phase of the first anionic surfactant is mitigated thereby rendering the liquid composition precursor recirculating in the loop an acceptable viscosity value. Preferably, the liquid composition precursor in the loop has a viscosity of about 0.01 to 10 Pa-s, preferably about 0.1 to 8 Pa-s, preferably about 0.2 to 6 Pa-s, at a shear rate of 10/sec and a temperature of 30° C.

The liquid cleaning composition herein may be acidic or alkali or pH neutral, depending on the ingredients incorporated in the composition. The pH range of the liquid cleaning composition is preferably from about 5 to 11, alternatively from about 7 to 9. However, with regard to the liquid composition precursor flowing in the recirculatory loop, it has been surprisingly found that a relatively low pH shortens the phase transition time of the hexagonal phased surfactant. Preferably, the liquid composition precursor in the loop has a pH of from about 2 to 8, alternatively from about 3 to 7, alternatively from about 4 to 6. When the pH of the liquid composition precursor in the loop is lower than 2, the first anionic surfactant could potentially degrade, while a relatively high pH (e.g., a pH of 10) prevents the hexagonal phase from dissolution and thus typically requires higher energy imparted to the liquid composition precursor flowing in the loop to overcome this viscosity challenge.

It is worth noting that the liquid cleaning composition obtained by the process of the present invention may or may not be the final composition sold to users. In one embodiment, the composition obtained by the present process is a final liquid cleaning composition. In an alternative, but preferred embodiment, the liquid cleaning composition obtained by the present process is a "white base" comprising ingredients that constitute the main portion of a final composition and that is simply lacking finishing ingredients or other minors that vary from product by product (e.g., dye, perfume oil). These finishing ingredients or minors can be added into the white base in a step after the present process to form the final composition. These finishing ingredients or minors can be added via a batch process (separate from the batch recirculatory process of the present invention) or a continuous process, preferably added via a continuous process such as an in-line process in fluid communication with the recirculatory batch processor of the present invention.

First Anionic Surfactant

The first anionic surfactant of the present invention is selected from the group consisting of AS, AES, and a combination thereof. Both the AS and AES exhibit a viscous hexagonal phase upon dilution from a concentrated form. Preferably, the first anionic surfactant is AES.

In one embodiment, the first anionic surfactant is contained in a first anionic surfactant composition before dispensing. The first anionic surfactant is preferably present from about 60% to 90%, alternatively from about 62% to 80%, alternatively from about 65% to 75%, by weight of the first anionic surfactant composition. In such concentration forms, the first anionic surfactant typically exhibits a lamellar phase in the first anionic surfactant composition. Accordingly, this is less viscous than when the first anionic surfactant is in a hexagonal phase. In addition to the first anionic surfactant, the first anionic surfactant composition may comprise a solvent such as water and/or ethanol, and a neutralizer such as sodium hydroxide and/or monoethanolamine. In one embodiment, the first anionic surfactant composition is an AES composition, wherein the AES composition comprises from about 60% to 90% by weight of the AES as well as water and sodium hydroxide. In another embodiment, the first anionic surfactant composition is an AES composition, wherein the AES composition comprises from about 65% to 75% by weight of the AES as well as water, monoethanolamine, and fatty acid. The levels of the ingredients in the first anionic surfactant composition could be varied as known in the art. In terms of pH value, the AES composition preferably has a pH of from about 10 to 13, more preferably from about 11 to 13.

The first anionic surfactant typically exhibits an isotropic phase in the liquid cleaning composition made by the process of the present invention, i.e., the active concentration thereof is below the active concentration boundary between hexagonal and isotropic phases. Preferably, the first anionic surfactant is present below 28%, alternatively from about 1% to 28%, alternatively from about 2% to 25%, alternatively from about 5% to 20%, alternatively from about 10% to 18%, by weight of the liquid cleaning composition.

The first anionic surfactant or the first anionic surfactant composition may have any suitable temperature, but preferably has a temperature higher than the ambient temperature because a higher temperature helps to "soften" or break the hexagonal phase of the first anionic surfactant. In one embodiment, the first anionic surfactant has a temperature of about 25° C. to 70° C., preferably about 30° C. to 50° C. before dispensing. Such an elevated temperature can be provided from any known methods in the art, e.g., heating or mixing with certain amount of water steam.

The AS and AES herein are of the formula $ROSO_3M$ and $RO(C_2H_4O)_xSO_3M$, respectively, wherein R is an alkyl having about 8 to 18 carbon atoms, x is 1 to 10, and M is a water-soluble cation such as ammonium, sodium, potassium, and monothanolamine cation or salts of the divalent magnesium ion with two anionic surfactant anions. The AES may be made as condensation products of ethylene oxide and monohydric alcohols having from about 8 to 18 carbon atoms. The alcohols can be derived from fats, e.g., coconut oil, palm oil, palm kernel oil, or tallow, or can be synthetic.

Examples of anionic surfactants suitable for use herein as the first anionic surfactant include, but are not limited to, ammonium lauryl sulfate, ammonium laureth sulfate, triethylamine lauryl sulfate, triethylamine laureth sulfate, triethanolamine lauryl sulfate, triethanolamine laureth sulfate, monoethanolamine lauryl sulfate, monoethanolamine laureth sulfate, diethanolamine lauryl sulfate, diethanolamine laureth sulfate, lauric monoglyceride sodium sulfate, sodium lauryl sulfate, sodium laureth sulfate, potassium laureth sulfate, sodium lauryl sarcosinate, sodium lauroyl sarcosinate, lauryl sarcosine, cocoyl sarcosine, ammonium cocoyl sulfate, ammonium lauroyl sulfate, sodium cocoyl sulfate, sodium lauroyl sulfate, potassium cocoyl sulfate, potassium lauryl sulfate, monoethanolamine cocoyl sulfate, sodium trideceth sulfate, sodium tridecyl sulfate, sodium methyl lauroyl taurate, sodium methyl cocoyl taurate, sodium lauroyl isethionate, sodium cocoyl isethionate, and mixtures thereof. In one preferred embodiment, the first anionic surfactant is a sodium laureth sulfate having an average of 0.7 to 3 moles, preferably 1 to 3 moles of ethoxy moieties per molecule.

Gel Breaker

The gel breaker of the present invention could be any ingredient in the liquid cleaning composition that is capable of functioning as a gel breaker or that is an intentionally added gel breaker. Preferably, the gel breaker is a common ingredient in the composition that is capable of functioning as a gel breaker, thus eliminating the need for removing the undesired gel breaker thereafter. In one embodiment, the gel breaker herein is selected from the group consisting of a second anionic surfactant, organic solvent, hydrotrope, hydrophobically modified polymer, water steam, and a combination thereof, wherein the second anionic surfactant is characterized by not exhibiting a hexagonal phase upon dilution. Preferably, before dispensing into the recirculatory loop, the gel breaker is contained in a gel breaker composition.

In one embodiment, the gel breaker is a second anionic surfactant that is characterized by not experiencing a hexagonal phase upon dilution, preferably is a linear alkylbenzene sulfonate (LAS). The LAS is a common anionic surfactant used in cleaning compositions. Preferably, before dispensing the LAS is contained in a LAS composition. The LAS is preferably present from about 50% to 100%, alternatively from about 70% to 99%, alternatively from about 90% to 98%, by weight of the LAS composition. The LAS composition may be acidic or alkali or pH neutral. In one embodiment, the LAS composition is pH neutral, i.e., the LAS is pre-neutralized by a neutralizer such as sodium hydroxide and/or monoethanolamine. In an alternative but preferred embodiment, the LAS composition is acidic, thereby enabling a desired low pH for the liquid composition precursor in the loop. This acidic LAS composition will be neutralized when it is added into the loop and meets with a neutralizer (e.g., sodium hydroxide or sodium carbonate that is added to the batch container) present in the liquid composition precursor. In the liquid cleaning composition made by the process, the LAS is present from about 1% to 30%, alternatively from about 3% to 20%, alternatively from about 5% to 15%, by weight of the composition. However, it is worth noting that in the liquid composition precursor recirculating in the recirculatory loop, the level of the LAS may be different from that in the liquid cleaning composition, because the level of the LAS injected into the loop is preferably at a certain weight ratio range in relation to the level of the first anionic surfactant injected into the loop downstream to maximize the LAS functioning as a gel breaker. This weight ratio of the gel breaker to the first anionic surfactant is described hereinafter.

The LAS herein can be any LAS classes known in the art. However, $C_{10}$-$C_{16}$ LAS is preferred. The LAS is normally prepared by sulfonation (using $SO_2$ or $SO_3$) of alkylbenzenes. Suitable alkylbenzene feedstocks can be made from olefins, paraffins or mixtures thereof using any suitable alkylation scheme, including sulfuric and HF-based processes. By varying the precise alkylation catalyst, it is possible to widely vary the position of covalent attachment of benzene to an aliphatic hydrocarbon chain. Accordingly the LAS herein can vary widely in 2-phenyl isomer and/or internal isomer content.

In another embodiment, the gel breaker is an organic solvent. The organic solvent herein encompasses those materials recognized in the art as organic solvents. The organic solvent can be selected from the group consisting of alcohol, ether, and a combination thereof, preferably is an alcohol. The alcohol can be selected from the group consisting of diol, triol, and a combination thereof. The alcohol can be either a short chain alcohol or a long chain alcohol. In one embodiment, the alcohol is a short chain alcohol, more preferably is selected from the group consisting of propylene glycol, ethanol, methanol, and a combination thereof. In an alternative embodiment, the alcohol is a long chain alcohol, more preferably is polyethylene glycol.

In yet another embodiment, the gel breaker is a hydrotrope. The hydrotrope herein encompasses those materials recognized in the art as hydrotropes. The hydrotrope can be selected from the group consisting of cumene sulfonate, xylene sulfonate, toluene sulfonate, urea, and a combination thereof. Non-limiting examples of the hydrotrope include: sodium cumene sulfonate, sodium toluene sulfonate, sodium xylene sulfonate, and sodium diisopropyl naphthalene sulfonate.

In yet another embodiment, the gel breaker is a hydrophobically modified polymer. The hydrophobically modified polymer herein encompasses those polymers that are hydrophobically modified in the art. One example of the hydrophobically modified polymer is a graft copolymer synthesized from polyalkylene oxides as a graft base and side chains formed by polymerization of a vinyl acetate, having an average of ≤1 graft site per 50 alkylene oxide units and mean molar masses Mw of from 3000 to 100 000.

In even yet another embodiment, the gel breaker is a water steam. The water steam typically has a temperature at or above 100° C. The heat from the water steam can help modify the hexagonal phase of the first anionic surfactant (to the desired, less viscous, isotropic phase).

Adjunct Ingredient

The liquid cleaning composition herein may comprise one or more adjunct ingredients. Suitable adjunct materials include but are not limited to: fatty acids, nonionic surfactants, cationic surfactants, structurants, solvents, builders, chelants, neutralizers, preservatives, pH modifiers, dye transfer inhibiting agents, dispersants, enzymes, and enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, photobleaches, perfume oils, perfume microcapsules, silicones, fabric softeners, carriers, hydrotropes, processing aids, hueing agents, and/or pigments. The precise nature of these adjunct ingredients and the levels thereof in the liquid cleaning composition will depend on the physical form of the composition and the nature of the cleaning operation for which it is to be used.

The above adjunct ingredients could be added to the batch container, or to the recirculatory loop, or to both the batch container and the loop of the present invention, depending on factors including the level of the ingredient in the liquid cleaning composition, the compatibility of the ingredient with other ingredients in the composition, the energy needed to combine the ingredient with other ingredients, etc. In one embodiment, some adjunct ingredients are added into the loop while others are added to the batch container. In another embodiment, certain ingredients are added both to the batch container and to the loop, i.e., the ingredient is separated into two or more portions, and these two or more portions are separately added to the batch container and to the loop.

A batch component is preferably an ingredient selected from the group consisting of water, solvent, builder, chelant, preservative, cationic surfactant, nonionic surfactant, pH modifier, perfume oil, dye, enzyme, and a combination thereof. In addition to the first anionic surfactant and the gel breaker that are added into the loop, a loop component is preferably an ingredient selected from the group consisting of fatty acid, nonionic surfactant, cationic surfactant, structurant, perfume microcapsule, silicone, and a combination thereof.

Process

The process of the present invention comprises the steps of:

a) providing a recirculatory batch processor, wherein the recirculatory batch processor comprises: i) a batch container containing a liquid composition precursor; and ii) a recirculatory loop in fluid communication with the batch container, recirculating at least a portion of the liquid composition precursor;

b) dispensing a first anionic surfactant into the loop at a first loop location while at least a portion of the liquid composition precursor is recirculating, wherein the first anionic surfactant is selected from the group consisting of alkyl sulfate (AS), alkyl ethoxy sulfate (AES), and a combination thereof; and c) dispensing a gel breaker into the loop at a second loop location while at least a portion of the liquid composition precursor is recirculating, wherein the second loop location is upstream of the first loop location, thereby making the liquid cleaning composition.

Preferably, in step b) the dispensing the first anionic surfactant into the loop is at a first rate, and in step c) the dispensing the gel breaker into the loop is at a second rate. The terms "first rate" and "second rate" herein refer to the amount of active added per unit time. Specifically, the first rate refers to the amount of the first anionic surfactant added (but not the amount of the first anionic surfactant composition added) per unit time, and the second rate refers to the amount of the gel breaker added (but not the amount of the gel breaker composition added) per unit time. In one embodiment, the first rate is from about 1 to 30 $m^3$/hour, alternatively from about 3 to 20 $m^3$/hour, alternatively from about 5 to 18 $m^3$/hour, and the second rate is from about 0.5 to 40 $m^3$/hour, alternatively from about 1 to 25 $m^3$/hour, alternatively from about 5 to 15 $m^3$/hour. It is understood that the first rate and second rate are also related to the batch cycle time of the process (i.e., the running time for making the desired liquid cleaning composition), the flow rate of the liquid composition precursor in the loop, the volume of the batch container, the concentration of the first anionic surfactant in the first anionic surfactant composition, the concentration of the gel breaker in the gel breaker composition, etc. For example, the first rate and second rate could be higher if the flow rate of the liquid composition precursor is higher.

It has been surprisingly found that a suitable ratio of the first rate to the second rate leads to an optimized dissolution effect of the first anionic surfactant. Without wishing to be bound by theory, it is believed that the suitable ratio of the first rate to the second rate as required alters the phase chemistry in a desirable way and therefore mitigates the hexagonal phase of the first anionic surfactant significantly. It is understood that the ratio of the first rate to the second rate roughly corresponds to the ratio of the amounts of the first anionic surfactant to the gel breaker present in the liquid composition precursor recirculating in the loop (but not necessarily corresponds to the ratio of the amounts of the first anionic surfactant to the gel breaker present in the liquid cleaning composition). In one embodiment, the ratio of the first rate to the second rate is from about 0.4:1 to 8:1, preferably from about 0.5:1 to 7:1, more preferably from about 0.6:1 to 6:1. Preferably, the first anionic surfactant is an AES and the gel breaker is a LAS, wherein the AES is contained in an AES composition before dispensing and present from about 60% to 90%, alternatively from about 62% to 80%, alternatively from about 65% to 75%, by weight of the AES composition, and the LAS is contained in a LAS composition before dispensing and present from about 50% to 100%, alternatively from about 70% to 99%, alternatively from about 90% to 98%, by weight of the LAS composition. In one embodiment, in the liquid composition precursor recirculating in the loop, the AES is present from about 20% to 35%, the LAS is present from about 1% to 25%, by weight of the liquid composition precursor, alternatively the AES is present from about 20% to 29%, the LAS is present from about 1% to 20%, by weight of the liquid composition precursor, alternatively the AES is present from about 29% to 35%, the LAS is present from about 10% to 20%, by weight of the liquid composition precursor.

Steps b) and c) may or may not start simultaneously. In one embodiment, steps b) and c) start simultaneously. In an alternative but preferred embodiment, step b) starts slightly later than step c), depending on factors such as the flow rate of the liquid composition precursor in the loop, the distance between the first loop location and the second loop location. In one embodiment, the liquid composition precursor flows at a flow rate of about 20 to 50 $m^3$/hour in the loop that has an cross-sectional area of about 0.005 to 0.02 $m^2$, the second loop location is positioned about 1 to 5 meters upstream of the first loop location, and step b) starts about 0.3 to 20 seconds later than step c). Also, steps b) and c) may or may not stop simultaneously.

In one embodiment, the first anionic surfactant is dispensed into the recirculatory loop via a first dispenser. This first dispenser can be any dispenser known in the art. Preferably, the first anionic surfactant is dispensed into the loop via a T-injection or a concentric injection, but more preferably via a concentric injection. In the concentric injection execution, the concentric feed tube of the concentric injection ends at the first loop location where the first anionic surfactant meets with the liquid composition precursor in the loop (the liquid composition precursor passing through the first loop location mainly comprises the gel breaker).

In one embodiment, a first mixer is positioned downstream of the first loop location but proximate thereto in the recirculatory loop. The concentric injection execution is preferred herein because it leads the first anionic surfactant and the liquid composition precursor directly to the first mixer without substantially meeting with each other. The first mixer could be any suitable mixer known in the art, e.g., a static mixer or a dynamic mixer. In one embodiment, the first mixer is a static mixer (e.g., a traditional static mixer, or SONOLATOR® as described in US Patent Publication No. 2011/0172137A). In an alternative but preferred embodiment, the first mixer is a dynamic mixer (e.g. IKA rotor-stator mill).

When a first mixer is utilized, a minimum amount of energy is required to achieve the desired homogeneity, and the person skilled in the art understands that this minimum amount of energy depends on the mixer used as well as the composition under study. The calculation method of the energy density is described hereinafter. In one embodiment, the energy density imparted to the liquid composition precursor passing through the first mixer is from about 10 to 100000 kJ/m$^3$, alternatively from about 100 to 10000 kJ/m$^3$.

In a second aspect, the energy density imparted to the liquid composition precursor passing through the first mixer is related to the residence time of the liquid composition precursor passing through the first mixer. In general, the higher the energy density, the shorter the residence time needed. In one embodiment, the liquid composition precursor passes through said first mixer with residence time of from about 0.001 to 100 seconds per recirculation pass, imparted with an energy density of from about 10 to 100000 kJ/m$^3$. Preferably, the liquid composition precursor passes through said first mixer with residence time of from about 0.01 to 30 seconds per recirculation pass, imparted with an energy density of from about 100 to 10000 kJ/m$^3$.

In a third aspect, the energy density imparted to the liquid composition precursor passing through the first mixer is related to the energy density applied to the liquid composition precursor in the batch container. Specifically, the higher the energy density imparted to the liquid composition precursor passing through the first mixer, the lower the energy density needed to be applied to the liquid composition precursor in the batch container. Also, given that there is always a need for mixing ingredients in the batch container (i.e., energy will always be applied to the batch container to mix ingredients therein), the energy density imparted to the liquid composition precursor passing through the first mixer could be reduced to some extent. In other words, the energy density imparted to the liquid composition precursor passing through the first mixer does not have to sufficiently achieve desired homogeneity because additional energy will eventually be applied to the liquid composition precursor in the batch container with significantly longer residence time. In one embodiment, the liquid composition precursor passes through said first mixer with residence time of from about 0.01 to 30 seconds per recirculation pass, imparted with an energy density of from about 100 to 10000 kJ/m$^3$, and the liquid composition precursor in the batch container is imparted with an energy density of from about 10 to 500 kJ/m$^3$ with residence time of from about 10 to 30 minutes. Preferably, the liquid composition precursor passes through said first mixer with residence time of from about 0.1 to 30 seconds per recirculation pass, imparted with an energy density of from about 100 to 1000 kJ/m$^3$, and the liquid composition precursor in the batch container is imparted with an energy density of from about 100 to 500 kJ/m$^3$ with residence time of from about 15 to 30 minutes.

Similar to the first anionic surfactant, preferably the gel breaker is dispensed into the recirculatory loop via a second dispenser. This second dispenser can be any dispenser known in the art (e.g., a T-injection or a concentric injection) as long as the second loop location is upstream of the first loop location. Preferably, the second dispenser is a concentric injection. A second mixer may or may not be positioned between the first loop location and the second loop location. When a second mixer is utilized, preferably it is positioned downstream but proximate to the second loop location. The second mixer could be any suitable mixer known in the art, e.g., a static mixer, or a dynamic mixer.

Preferably, the gel breaker is a LAS. In one embodiment, the LAS that will be present in the resulting liquid cleaning composition is wholly added to the liquid composition precursor via the recirculatory loop (e.g., the second loop location). But in the execution of acidic LAS composition, preferably the LAS is separated into two portions: one portion of the LAS is added into the loop as a loop component and the other portion is added to the batch container as a batch component. Typically when the unneutralized LAS (i.e., the LAS from an acidic LAS composition) meets with the liquid composition precursor in the loop, a neutralization reaction occurs between the LAS and neutralizer (e.g., sodium hydroxide or sodium carbonate that is added to the batch container) and releases a large amount of heat. Such a large amount of heat release is undesired as it causes problems like discoloration of the composition, safety concerns in production, apparatus corrosion. Therefore, the separate addition of the LAS (namely, one portion of the LAS into the loop and the other portion to the batch container) is preferred.

In one embodiment, the process herein further comprises step d): dispensing a third loop component into the loop at a third loop location. The third loop location could be at any position in the recirculatory loop, i.e., upstream of the second loop location, or between the first loop location and the second loop location, or downstream of the first loop location. Preferably, the third loop location is downstream of the first loop location, thereby not complicating the phase behavior of the first anionic surfactant. In one embodiment, the third loop component is dispensed into the loop at the third loop location via a third dispenser (e.g., a T-injection or a concentric injection). A third mixer may or may not be positioned downstream of the third loop location. When the third mixer is utilized, preferably it is positioned downstream but proximate to the third loop location. The third mixer could be any suitable mixer known in the art, e.g., a static mixer, or a dynamic mixer. If there are three or four or more loop components, these loop components can be dispensed either at the same third loop location or at different loop locations in the loop.

In one embodiment, the process herein further comprises step e): adding a batch component into the batch container. The batch components could be added either simultaneously or sequentially at a time.

The gel breaker, the third loop component, and the batch component are not necessarily different. For example, as mentioned before, the LAS could be added separately, where one portion is added into the loop at the second loop location as a gel breaker and the other portion is added into the batch container as a batch component. Also, a third portion of the LAS could be added into the loop at the third loop location as a third loop component. Another example, nonionic surfactant (e.g., $C_{12}$-$C_{15}$ alcohol ethoxylated with 7 moles of ethylene oxide) could be separately added into the loop at the third loop location as a third loop component and into the batch container as a batch component. Furthermore, it is understood that the first anionic surfactant, particularly the pre-diluted first anionic surfactant with a concentration of lower than 30% by weight active, could be added into the loop at the third loop location as a third loop component and into the batch container as a batch component.

According to the process of the present invention, the ingredients (including the first anionic surfactant, the gel breaker, the loop component, and the batch component) could flow into the loop either during a single pass of the liquid composition precursor or during several or numerous passes. It is understood that all of the ingredients (not only those as a loop component) could flow into the loop for one or more passes, because the loop is in fluid communication with the batch container and at least a portion of the batch components recirculates in the loop. Also, it is understood that the ingredients could flow into the loop either for the same number of times or for different number of times (e.g., certain loop component is added into the loop later than other ingredients and thus recirculates in the loop for fewer passes than the earlier-added ingredients). Preferably, the ingredients recirculate in the loop for multiple times, preferably recirculate until the liquid composition precursor in the batch container achieves the desired level (and preferably achieves the desired homogeneity) for each ingredient as in the liquid cleaning composition. When the desired level and homogeneity for each ingredient are achieved in the liquid composition precursor, the composition is collected in the batch container and thereafter flows out of the recirculatory batch processor via a processor outlet.

The process herein is operated under appropriate pressure depending on factors such as the mixer(s) used, the physical characteristics of the liquid composition precursor, and the production capacity needed. Typically the pressure required by the present process is not as high as in a traditional continuous process, which needs high pumping capacity to precisely control ratios of ingredients and thus which generates significant pressure drops. In one embodiment, the operation pressure of the present process (i.e., the pressure in the loop) is from about 2 to 10 bar, preferably from 3 to 6 bar.

The liquid composition precursor flows through the loop at any suitable flow rate depending on factors including the production capacity needed, the batch cycle time, the volume of the batch container, the rates of dispensing loop components into the loop, the physical characteristics of the liquid composition precursor (e.g., viscosity), etc. In particular, the flow rate of the liquid composition precursor through the loop is related to the batch cycle time of the process and volume of the batch container. For example, the batch cycle time is about 10 to 60 minutes at a flow rate of about 5 to 50 $m^3$/hour through the recirculatory loop with a batch having a volume of about 5 to 50 $m^3$. Another example, the batch cycle time is about 20 to 60 minutes at a flow rate of about 20 to 50 $m^3$/hour through the recirculatory loop with a batch container having a volume of about 10 to 30 $m^3$.

In a highly preferred embodiment, the process herein comprises the steps of:

a) providing a recirculatory batch processor, wherein the recirculatory batch processor comprises: i) a batch container containing a liquid composition precursor; and ii) a recirculatory loop in fluid communication with the batch container, recirculating at least a portion of the liquid composition precursor;

b) dispensing, at a first rate, an AES into the loop at a first loop location while at least a portion of the liquid composition precursor is recirculating, wherein the AES is contained in an AES composition before dispensing and present from about 60% to 90% by weight of the AES composition; and c) dispensing, at a second rate, a LAS into the loop at a second loop location while at least a portion of the liquid composition precursor is recirculating, wherein the LAS is contained in a LAS composition before dispensing and present from about 50% to 100% by weight of the LAS composition, wherein the second loop location is upstream of the first loop location, and wherein the ratio of the first rate to the second rate is from about 0.5:1 to 7:1, thereby making the liquid cleaning composition, wherein the AES is present from about 5% to 28% by weight of the composition.

Even more preferably, the process herein further comprises the steps of:

d) dispensing a third loop component into the loop at a third loop location, wherein the third loop location is downstream of the first loop location, and wherein the third loop component is selected from the group consisting of fatty acid, nonionic surfactant, cationic surfactant, structurant, perfume microcapsule, silicone, and a combination thereof; and e) adding a batch component into the batch container, wherein the batch component is selected from the group consisting of water, solvent, builder, chelant, preservative, cationic surfactant, nonionic surfactant, pH modifier, perfume oil, dye, enzyme, and a combination thereof.

In addition to mitigating the hexagonal phase as well as allowing for maximum formulation flexibility, the process of the present invention achieves significant advantages particularly compared to a traditional batch process or continuous process. Specifically, the traditional batch process is generally considered inefficient and time-consuming because follow-up steps have to be idle until the mixing step in the batch container is finished. Also, the limited range of the batch container size limits the production capacity and thus causes scale-up difficulties. In sharp contrast, the recirculatory batch process of the present invention enables an efficient production and allows for expanding production capacity by simply accelerating the flow rate of the liquid composition precursor in the loop. Moreover, the traditional continuous process is indeed more efficient than the batch process, but as mentioned previously, the continuous process typically requires a precise control of ratios of each injected ingredient due to a lack of buffer. Also, the continuous process is not flexible for a change in order of addition. By contrast, as the batch container in the present process plays a role as a buffer, the present recirculatory batch process does not require either a precise control of ratios of ingredients or a fixed order of addition of ingredients, particularly for those added to the batch container.

Furthermore, by using a common ingredient found in cleaning compositions as a gel breaker and adding the first anionic surfactant to the flow of the gel breaker, the process of the present invention increases the processible concentration range of the first anionic surfactant. More importantly, the present process eliminates the need for a separate dilution operation as well as the need for a subsequent step of removing undesired material or excessive amount of water.

Recirculatory Batch Processor

In another aspect, the present invention is directed to a recirculatory batch processor, comprising: a batch container; a recirculatory loop in fluid communication with the batch container; a first dispenser in fluid communication with the loop for dispensing a first anionic surfactant at a first loop location into the loop; and a second dispenser in fluid communication with the loop for dispensing a gel breaker at a second loop location into the loop, wherein the second loop location is upstream of the first loop location, and wherein the first anionic surfactant is selected from the group consisting of AS, AES, and a combination thereof.

The second loop location is upstream of the first loop location. In one embodiment, the second loop location is about 0.1 to 20 meters, alternatively about 1 to 10 meters, alternatively about 2 to 8 meters, upstream of the first loop location. In another embodiment, the second loop location is positioned upstream of the first loop location but proximate thereto.

In one embodiment, the recirculatory loop is in fluid communication with the batch container at two distinct locations: a loop inlet and a loop outlet. Preferably, the loop inlet is positioned in a location closer to the bottom of the batch container than the loop outlet, which facilitates achieving homogeneity of the ingredients contained in the batch container. In one embodiment, the loop inlet is positioned at the bottom of the batch container, and the loop outlet is positioned higher than the loop inlet, e.g., near the top of the batch container.

The recirculatory batch processor could comprise two or more batch containers and/or two or more recirculatory loops. In one embodiment, the recirculatory batch processor comprises two or more batch containers that are connected to one another via two or more loops. In another embodiment, each of the two or more batch containers is in fluid communication with an individual loop, but these two or more batch containers share certain devices (e.g., a batch dispenser). Alternatively, the recirculatory batch could comprise one batch container and two or more loops, wherein each of the two or more loops is in fluid communication with the one batch container.

The recirculatory batch processor herein preferably has a processor outlet for the formed composition to flow out of the processor. The processor outlet could be positioned at any location of the present processor, either in the batch container or in the loop. Also, the processor outlet can be positioned at the same location as the loop inlet or the loop outlet, or at a position distinct from the loop inlet or the loop outlet. In one embodiment, the processor outlet is positioned at or close to the bottom of the batch container. In an alternative embodiment, the processor outlet is in the loop, e.g., upstream of the second loop location, between the first loop location and the second loop location, or downstream of the first loop location. Preferably, the processor outlet is positioned upstream of the second loop location.

The recirculatory loop herein preferably has a pump to force the liquid composition precursor to flow through the loop. The pump could be any pump known in the art, non-limiting examples of which include: a centrifugal pump such as an in-line vertical centrifugal pump, positive displacement pump, power piston, screw pump, rotary pump, jet pump, and an elbow pump. The pump can be positioned at any location of the present loop, e.g., upstream of the second loop location, between the first loop location and the second loop location, or downstream of the first loop location. Preferably, the pump is positioned upstream of the second loop location, more preferably proximate to the loop inlet. In one embodiment, the pump is a positive displacement pump positioned upstream of the second loop location and proximate to the loop inlet.

In the LAS execution (that LAS is injected as a gel breaker at the second loop location), preferably a heat exchanger is positioned in the loop due to the release of large amount of heat caused by neutralization as illustrated before. The heat exchanger may be positioned upstream or downstream of the second loop location, but preferably is upstream of the second loop location but downstream of the pump. In the processor outlet execution, the processor outlet can be positioned either upstream or downstream of the heat exchanger, preferably upstream of the heat exchanger. In one embodiment, there are two or more heat exchangers in the loop, e.g., one heat exchanger is upstream of the second loop location, and the other heat exchanger is downstream of the second loop location.

In one embodiment, the first dispenser is a T-injection or a concentric injection, but preferably is a concentric injection. Preferably, the recirculatory batch processor comprises a concentric injection that ends at the first loop location for dispensing the first anionic surfactant and a first mixer downstream of the first loop location but preferably proximate thereto in the loop. More preferably, the first mixer is a dynamic mixer. Likewise, the second dispenser is preferably a T-injection or a concentric injection, but more preferably is a concentric injection. In one embodiment, a second mixer is positioned between the first loop location and the second loop location.

In one embodiment, the recirculatory batch processor comprises a third dispenser in fluid communication with the loop for dispensing a third loop component at a third loop location into the loop. Preferably, the third loop component is selected from the group consisting of fatty acid, nonionic surfactant, cationic surfactant, structurant, perfume microcapsule, silicone, and a combination thereof.

In one embodiment, the recirculatory batch processor comprises a batch dispenser in fluid communication with the batch container for dispensing a batch component to the batch container. Preferably, the batch component is selected from the group consisting of water, solvent, builder, chelant, polymer, preservative, cationic surfactant, nonionic surfactant, pH modifier, perfume oil, dye, enzyme, and a combination thereof.

Method for Determining of Viscosity for Liquid Compositions

Unless otherwise specified, the viscosity is measured using an AR G2 rheometer (TA Instrument Ltd.), with a truncated cone spindle having an angle of 1° 59'24" and a gap of 49 microns. The shear rate increases from 1 $s^{-1}$ to 500 $s^{-1}$, and the rheology is read when the measurement achieves <5% variation at each shear rate. All the measurements are done at 30° C.

Calculation Method of Energy Density

For a static mixer, the energy density can be calculated as the pressure loss across the mixer. For a dynamic mixer, the energy density can be calculated roughly by dividing the power draw by the volumetric flow rate. Power draw can be calculated via the following formula 1:

$$P_f = P_T + P_F + P_L \qquad \text{Formula 1}$$

Wherein $P_T$ is the power required to rotate the rotor against the liquid, $P_F$ is the additional power requirements from the flow of liquid as represented by the pressure drop times the flow rate, and $P_L$ is the power lost, for example from bearings, vibration, or noise.

EXAMPLES

The Examples herein are meant to exemplify the present invention but is not used to limit or otherwise define the scope of the present invention. Examples 1-3 are liquid laundry detergent composition examples according to the present invention, Examples 1A-1E are process examples according to the present invention, and Examples 1F-1H are comparative process examples.

Examples 1-3

Formulations of Liquid Laundry Detergent Compositions

The following liquid laundry detergent compositions shown in Table 1 are made comprising the listed ingredients in the listed proportions (weight %).

TABLE 1

| | 1 | 2 | 3 |
|---|---|---|---|
| $C_{12-14}AE_{1-3}S$ | 17.7 | 7 | 18 |
| $C_{11-13}LAS$ | 3.2 | 3 | 15 |
| Surfonic ®L24-9 a | 0 | 4 | 21 |
| Citric acid | 4.2 | 3 | 4 |
| Boric acid | 3 | 0 | 0 |
| $C_{12}$-$C_{18}$ fatty acid | 0 | 4 | 8 |
| Na-DTPA b | 0.6 | 0.2 | 0.2 |
| 1,2 propanediol | 0 | 5 | 14 |
| Monoethanolamine | 0 | 1 | 8 |
| Glycerol | 4.5 | 0 | 0 |
| Ethanol | 0 | 1 | 0 |
| Lauryl trimethyl ammonium chloride | 1.2 | 0 | 0 |
| Potassium sulfite | 0 | 0.2 | 0 |
| NaOH | Up to pH 8 | Up to pH 8 | Up to pH 8 |
| Protease | 0 | 0.5 | 0.5 |
| Amylase | 0 | 0.1 | 0.1 |
| Dye | 0 | 0.002 | 0.002 |
| Perfume microcapsule | 0 | 0 | 0.5 |
| Perfume oil | 0 | 0.3 | 0.5 |
| Water | Add to 100 | Add to 100 | Add to 100 |

a Surfonic ®L24-9 is $C_{12-14}$ alcohol ethoxylated with 9 moles of ethylene oxide as a nonionic surfactant, available from Huntsman
b penta sodium salt diethylene triamine penta acetic acid as a chelant Example 1A Process of Making the Liquid Laundry Detergent Composition of Example 1 According to the Present Invention Process Example 1A comprises the steps of:

a) providing a recirculatory batch processor, wherein the recirculatory batch processor comprises a batch container and a recirculatory loop in fluid communication with the batch container, wherein the batch container has a volume of 80 liters and the loop has a cross-sectional area of about 0.0005 $m^2$;

b) adding citric acid, boric acid, Na-DTPA, glycerol, lauryl trimethyl ammonium chloride, NaOH, and water into the batch container to form a liquid composition precursor, and recirculating the liquid composition precursor in the loop with a flow rate of 3.7 kg/min;

c) dispensing, at a first rate of 1.7 kg/min, $C_{12-14}AE_{1-3}S$ into the loop at a first loop location for about 8.3 minutes while the liquid composition precursor is recirculating, wherein the $C_{12-14}AE_{1-3}S$ is contained in an AES composition before dispensing, wherein the AES composition comprises 67% by weight of the $C_{12-14}AE_{1-3}S$ and 33% by weight of water;

d) dispensing, at a second rate of 0.4 kg/min, $C_{11-13}LAS$ into the loop at a second loop location for about 6.5 minutes while the liquid composition precursor is recirculating, wherein the $C_{11-13}LAS$ is contained in a LAS composition before dispensing, wherein the LAS composition comprises 97% by weight of the $C_{11-13}LAS$ and 3% of water, wherein the second loop location is about 1 meter upstream of the first loop location, and wherein step c) and step d) start simultaneously after step b);

e) using a dynamic mixer (Ytron ZO from Ytron process Technology Gmb & Co.KG) positioned downstream of the first loop location but proximate thereto to impart an energy density of 650 kJ/$m^3$ to the liquid composition precursor passing through the dynamic mixer;

f) applying an energy density of 200 kJ/$m^3$ to the batch container to form a liquid laundry detergent composition, wherein each ingredient in the liquid laundry detergent composition is present in the level as specified for Example 1 in Table 1, and wherein the batch cycle time of the recirculatory batch processor (i.e., the total time of running steps a) to 0) is about 40 minutes.

Example 1B

Process of Making the Liquid Laundry Detergent Composition of Example 1 According to the Present Invention Process Example 1B is the same as Process Example 1A, except for the following: the liquid composition precursor flows in the recirculatory loop at a flow rate of 3.4 kg/min, in step c) the $C_{12-14}AE_{1-3}S$ is dispensed into the loop at a first rate of 1.6 kg/min for about 8.9 minutes, and in step d) the $C_{11-13}LAS$ is dispensed into the loop at a second rate of 0.9 kg/min for about 3.1 minutes.

Example 1C

Process of Making the Liquid Laundry Detergent Composition of Example 1 According to the Present Invention Process Example 1C is the same as Process Example 1A, except for the following: the liquid composition precursor flows in the recirculatory loop at a flow rate of 3.1 kg/min, in step c) the $C_{12-14}AE_{1-3}S$ is dispensed into the loop at a first rate of 1.5 kg/min for about 9.7 minutes, and in step d) the $C_{11-13}LAS$ is dispensed into the loop at a second rate of 1.3 kg/min for about 2.0 minutes.

Example 1D

Process of Making the Liquid Laundry Detergent Composition of Example 1 According to the Present Invention Process Example 1D is the same as Process Example 1A, except for the following: the liquid composition precursor flows in the recirculatory loop at a flow rate of 2.8 kg/min, in step c) the $C_{12-14}AE_{1-3}S$ is dispensed into the loop at a first rate of 1.3 kg/min for about 10.8 minutes, and in step d) the $C_{11-13}LAS$ is dispensed into the loop at a second rate of 1.8 kg/min for about 1.4 minutes.

Example 1E

Process of Making the Liquid Laundry Detergent Composition of Example 1 According to the Present Invention Process Example 1E is the same as Process Example 1A, except for the following: the liquid composition precursor flows in the recirculatory loop at a flow rate of 2.5 kg/min, in step c) the $C_{12-14}AE_{1-3}S$ is dispensed into the loop at a first rate of 1.1 kg/min for about 12.3 minutes, and in step d) the $C_{11-13}LAS$ is dispensed into the loop at a second rate of 2.4 kg/min for about 1.1 minutes.

Examples 2A-3A

Process of Making the Liquid Laundry Detergent Compositions of Examples 2-3 According to the Present Invention Process Examples 2A-3A comprise the steps of:

a) providing a recirculatory batch processor, wherein the recirculatory batch processor comprises a batch container and a recirculatory loop in fluid communication with the batch container, wherein the batch container has a volume of 80 liters, wherein the loop has a cross-sectional area of about 0.0005 $m^2$;

b) adding Surfonic®L24-9, citric acid, Na-DTPA, 1,2 propanediol, monoethanolamine, ethanol (if any), potassium sulfite (if any), NaOH, protease, amylase, dye, perfume oil, and water into the batch container to form a liquid composition precursor, and recirculating the liquid composition precursor in the loop with a flow rate of 4 kg/min;

c) dispensing, at a first rate of 1.6 kg/min, $C_{12-14}AE_{1-3}S$ into the loop at a first loop location while the liquid composition precursor is recirculating, wherein the $C_{12-14}AE_{1-3}S$ is contained in an AES composition before dispensing, wherein the AES composition comprises 67% by weight of the $C_{12-14}AE_{1-3}S$ and 33% by weight of water;

d) dispensing, at a second rate of 1.0 kg/min, $C_{11-13}LAS$ into the loop at a second loop location while the liquid composition precursor is recirculating, wherein the $C_{11-13}LAS$ is contained in a LAS composition before dispensing, wherein the LAS composition comprises 97% by weight of the $C_{11-13}LAS$ and 3% of water, wherein the second loop location is about 1 meter upstream of the first loop location, and wherein step c) and step d) start simultaneously;

e) dispensing $C_{12}$-$C_{18}$ fatty acid into the loop at a third loop location and perfume microcapsule (if any) at a fourth loop location, wherein the third loop location is downstream of the first loop location and the fourth loop location is downstream of the third loop location;

e) using a dynamic mixer (VMI Rayneri TRIMIX available from Ytron-Quadro (UK) LTD) positioned downstream of the first loop location but proximate thereto to impart an energy density of 650 kJ/$m^3$ to the liquid composition precursor passing through the dynamic mixer;

f) applying an energy density of 200 kJ/$m^3$ to the batch container to form a white base; and g) the white base obtained in step f) flowing out of the processor via a processor outlet positioned upstream of the first loop location and flowing through a separate continuous process, wherein protease, amylase, dye, and perfume oil are added into the white base during the separate continuous process, thus forming a liquid laundry detergent composition, wherein each ingredient in the liquid laundry detergent composition is present in the level as specified for Examples 2-3 in Table 1, and wherein the batch cycle time of the recirculatory batch processor (i.e., the total time of running steps a) to 0) is about 40 minutes.

Comparative Example 1F

Comparative Process without the Addition of LAS

Comparative Example 1F is the same as Process Example 1A, except for the following: no LAS is either dispensed into the recirculatory loop (i.e., Comparative Example 1F does not comprise step d) as described in Example 1A) or present in the formed liquid laundry detergent composition; the liquid composition precursor flows in the loop at a flow rate of 4 kg/min; and in step c) the $C_{12-14}AE_{1-3}S$ is dispensed into the loop at a first rate of 1.8 kg/min for about 8 minutes.

Comparative Example 1G

Comparative Batch Process of Making the Liquid Laundry Detergent Composition of Example 1

Comparative Process Example 1G comprises the steps of:

a) mixing a combination of NaOH and water in a batch container by applying a shear of 200 rpm;

b) adding citric acid, boric acid, $C_{11}$-$C_{13}$ LAS, and NaOH in sequence into the batch container, keeping on mixing by applying a shear of 200 rpm;

c) cooling down the temperature of the combination obtained in step b) to 25° C.;

d) adding glycerol into the batch container;

e) adding $C_{12-14}AE_{1-3}S$ and Na-DTPA into the batch container, mixing by applying a shear of 250 rpm until the combination is homogeneously mixed, and adjusting pH to 8, wherein the $C_{12-14}AE_{1-3}S$ is pre-diluted to 25% by weight active prior to being added into the batch container, thus forming a liquid laundry detergent composition, wherein each ingredient in the composition is present in the level as specified for Example 1 in Table 1.

Comparative Example 1H

Comparative Continuous Process of Making the Liquid Laundry Detergent Composition of Example 1

Comparative Process Example 1H comprises the steps of: adding NaOH, water, citric acid, boric acid, $C_{11}$-$C_{13}$ LAS, glycerol, $C_{12-14}AE_{1-3}S$, and Na-DTPA in sequence into a continuous production line, wherein the $C_{12-14}AE_{1-3}S$ is pre-diluted to 25% by weight active prior to being added into the continuous production line. Each ingredient in the composition is present in the level as specified for Example 1 in Table 1.

Comparative Data of Process Examples 1A-1F on Viscosity

Comparative experiments measuring the viscosity of the liquid compositions according to the processes described in Examples 1A-1F, are conducted. Examples 1A-1E have varied ratios of the first rate (the rate of dispensing the AES) to the second rate (the rate of dispensing the LAS), and Comparative Example 1F is the control without the injection of LAS. Viscosity is assessed of a theoretical sample taken immediately downstream of the dynamic mixer (downstream of the first loop location) at 10 second after simultaneously adding the AES and LAS at the prescribed rates. The theoretical sample comprises three portions: a liquid composition precursor formed by the ingredients added in step b) of Examples 1A-1F, the LAS composition (comprising 97% by weight active and 3% by weight of water) added into the loop, and the AES composition (comprising 67% by weight active and 33% by weight of water) added into the loop. The levels of the three portions of the theoretical sample are specified in Table 2 (weight %), and the ingredients forming the liquid composition precursor are specified in the listed levels in Table 3 (weight %).

TABLE 2

| | 1A | 1B | 1C | 1D | 1E | 1F |
|---|---|---|---|---|---|---|
| AES composition | 39 | 36 | 33 | 30 | 26 | 40 |
| LAS composition | 6 | 13 | 20 | 28 | 37 | 0 |
| Liquid Composition Precursor | 55 | 51 | 47 | 42 | 37 | 60 |

TABLE 3

| | | 1A-1F |
|---|---|---|
| Liquid Composition Precursor | Citric acid | 5.9 |
| | Boric acid | 4.2 |
| | Na-DTPA a | 0.84 |
| | Glycerol | 6.4 |
| | Lauryl trimethyl ammonium chloride | 1.7 |
| | NaOH | 1.7 |
| | Water | Add to 100 |

a penta sodium salt diethylene triamine penta acetic acid as a chelant

The theoretical samples are recreated in the laboratory based on the assumptions described herein. The viscosity of the theoretical samples is measured at a shear rate of 10/sec and a temperature of 30° C., according to the method for determining of viscosity for liquid compositions as described herein above. The viscosity values of the theoretical samples are shown in Table 4.

TABLE 4

| | 1A | 1B | 1C | 1D | 1E | 1F |
|---|---|---|---|---|---|---|
| First rate/kg/min | 1.7 | 1.6 | 1.5 | 1.3 | 1.1 | 1.8 |
| Second rate/kg/min | 0.4 | 0.9 | 1.3 | 1.8 | 2.4 | NA |
| Ratio of first rate to second rate | 4.3 | 1.8 | 1.2 | 0.7 | 0.5 | NA |
| Flow rate[1]/kg/min | 3.7 | 3.4 | 3.1 | 2.8 | 2.5 | 4.0 |
| Sample Viscosity/Pa-s | 0.8 | 0.6 | 0.9 | 1.1 | 5.3 | 7.0 |

[1]Flow rate of the liquid composition precursor flowing in the recirculatory loop As shown in Table 4, all of the liquid composition precursors according to the present processes 1A-1E demonstrate improved viscosity properties over the liquid composition precursor according to Comparative Example 1F.

Furthermore, when compared with Comparative Examples 1G and 1H, the processes according to the present invention (Examples 1A-1E) eliminate the need for a separate pre-dilution operation for the AES.

Unless otherwise indicated, all percentages, ratios, and proportions are calculated based on weight of the total composition. All temperatures are in degrees Celsius (° C.) unless otherwise indicated. All component or composition levels are in reference to the active level of that component or composition, and are exclusive of impurities, for example, residual solvents or by-products, which may be present in commercially available sources.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process of making a liquid cleaning composition, comprising the steps of:

a) providing a recirculatory batch processor,
   wherein said recirculatory batch processor comprises: i) a batch container containing a liquid composition precursor; and ii) a recirculatory loop in fluid communication with said batch container, recirculating at least a portion of said liquid composition precursor;

b) dispensing a first anionic surfactant into said loop at a first loop location while at least a portion of said liquid composition precursor is recirculating,
   wherein said first anionic surfactant is alkyl ethoxy sulfate (AES),
   wherein said first anionic surfactant is contained in a first anionic surfactant composition before dispensing and present from about 60% to about 90% by weight of said first anionic surfactant composition; and c) dispensing a gel breaker into said loop at a second loop location while at least a portion of said liquid composition precursor is recirculating, wherein said second loop location is upstream of said first loop location,
   wherein said gel breaker is a second anionic surfactant, wherein said second anionic surfactant is linear alkylbenzene sulfonate (LAS) characterized by not exhibiting a hexagonal phase upon dilution, and is present in an amount from 50% to about 100% by weight of the LAS composition, wherein the dispensing said AES into said loop is at a first rate, and the dispensing said LAS into said loop is at a second rate, wherein the ratio of said first rate to said second rate is from 0.4:1 to about 8:1, and wherein the liquid cleaning composition is made having from about 5% to about 28% of said AES by weight of the liquid cleaning composition.

2. The process according to claim 1, wherein said first anionic surfactant has a temperature of about 30° C. to about 50° C. before dispensing.

3. The process according to claim 1, wherein a first mixer is positioned downstream of said first loop location but proximate thereto in said loop, wherein said first mixer is a dynamic mixer.

4. The process according to claim 3, wherein said liquid composition precursor passes through said first mixer with residence time of from about 0.001 to about 100 seconds per recirculation pass, imparted with an energy density of from about 10 to about 100000 $kJ/m^3$.

5. The process according to claim 4, wherein said liquid composition precursor passes through said first mixer with residence time of from about 0.01 to about 30 seconds per recirculation pass, imparted with an energy density of from about 100 to about 10000 $kJ/m^3$, and said liquid composition precursor in said batch container is imparted with an energy density of from about 10 to about 500 $kJ/m^3$ with residence time of from about 10 to about 30 minutes.

6. The process according to claim 1, wherein said first anionic surfactant is dispensed into said loop via a concentric injection.

7. The process according to claim 1, wherein the liquid composition is made having from about 5% to about 25% of said first anionic surfactant by weight of the liquid cleaning composition.

8. The process according to claim 1, wherein said liquid composition precursor recirculating in said loop has a viscosity of about 0.01 to about 10 Pa-s at a shear rate of 10/sec and a temperature of 30° C.

9. The process according to claim 1, further comprising step d): dispensing a third loop component into said loop at a third loop location, wherein said third loop component is selected from the group consisting of fatty acid, nonionic surfactant, cationic surfactant, perfume microcapsule, silicone, and a combination thereof, wherein said third loop location is downstream of said first loop location.

10. The process according to claim 1, further comprising step e): adding a batch component into said batch container, wherein said batch component is selected from the group consisting of water, solvent, builder, chelant, preservative, cationic surfactant, nonionic surfactant, pH modifier, perfume oil, dye, enzyme, and a combination thereof.

* * * * *